US005845744A

United States Patent [19]

Beck et al.

[11] Patent Number: 5,845,744

[45] Date of Patent: Dec. 8, 1998

[54] LADDER LEVELLING DEVICE

[75] Inventors: Harold Anthony Ernest Beck, 6612-44B Avenue, Camrose, Alberta, Canada, T4V 2V5; Jason Todd Anthony Beck, 3128-49 Street, S.W., Calgary, Alberta, Canada, T3E 3Y3

[73] Assignees: Harold Anthony Ernest Beck; Jason Todd Anthony Beck; Ernest Kenneth Cucheran, all of Alberta, Canada

[21] Appl. No.: 972,963

[22] Filed: Nov. 19, 1997

[51] Int. Cl.[6] ..... E04C 7/44

[52] U.S. Cl. ..... 182/204; 182/111; 182/109

[58] Field of Search ..... 182/204, 205, 182/201, 111, 109

[56] References Cited

U.S. PATENT DOCUMENTS

| | | |
|---|---|---|
| 1,223,367 | 4/1917 | Brown . |
| 1,251,192 | 12/1917 | Drummond . |
| 1,280,741 | 10/1918 | Hunn . |
| 1,329,740 | 2/1920 | Barron . |
| 1,887,495 | 11/1932 | Carter, Jr. . |
| 2,147,052 | 2/1939 | Noone . |
| 3,047,061 | 7/1962 | Wilcox et al. . |
| 3,179,206 | 4/1965 | Studer . |
| 3,484,814 | 12/1969 | Meehan . |
| 3,527,321 | 9/1970 | Brown . |
| 3,882,966 | 5/1975 | Fasano . |
| 4,014,406 | 3/1977 | Easton . |
| 4,085,820 | 4/1978 | Cerny . |
| 4,423,797 | 1/1984 | Batten . |
| 4,807,720 | 2/1989 | Kim . |
| 5,325,936 | 7/1994 | Baker ..... 182/204 |

*Primary Examiner*—Alvin C. Chin-Shue
*Attorney, Agent, or Firm*—Davis and Bujold

[57] ABSTRACT

A ladder levelling device includes a housing, a telescopic member and a lever. The lever is positioned within an interior cavity of the telescopic member. The lever has a mounting end and a gripping end. The mounting end of the lever is pivotally mounted at a ground engaging end of the telescopic member. The gripping end of the lever is accessible through a lever access opening at a handgrip end of the telescopic member. A locking pin is carried by the lever. The lever is pivotable between a locking position and a release position. In the locking position the locking pin carried by the lever extends through an aperture in the telescopic member and engages one of a plurality of apertures in the housing. In the release position the locking pin is retracted from the apertures in the housing.

10 Claims, 4 Drawing Sheets

LADDER LEVELLING DEVICE

FIELD OF THE INVENTION

The present invention relates to a ladder levelling device.

BACKGROUND OF THE INVENTION

There is extensive patent literature relating to ladder levelling devices. The ladder levelling devices generally consist of a housing which is attachable to a ladder, a member that is telescopically received in the housing and a locking mechanism that locks the telescopic member in a selected position in relation to the housing. The unique aspect of each ladder levelling device generally centers upon their mode of adjustment.

U.S. Pat. No. 1,251,192 which issued to Drummond in 1917, U.S. Pat. No. 3,484,814 which issued to Meehan in 1969, U.S. Pat. No. 4,085,820 which issued to Cerny in 1978 all use housings having a plurality of apertures spaced at regular intervals. The corresponding locking mechanism consists of locking members biased by springs into engagement with the apertures. When the spring is compressed the members retract permitting the telescopic member to move relative to the housing.

U.S. Pat. No. 1,329,740 which issued to Barron in 1920, U.S. Pat. No. 1,887,495 which issued to Carter in 1932, U.S. Pat. No. 3,179,206 which issued to Studer in 1965, and U.S. Pat. No. 3,882,866 which issued to Fasano all use housings having a plurality stops. The corresponding locking mechanism is a pivotally mounted lever biased by springs into engagement with a selected one of the stops. U.S. Pat. No. 3,527,321 which issued to Brown in 1970 discloses a variation on the housing with stops. The corresponding locking mechanism is a cantilever lever secured at one end of a flat spring which biases the lever into engagement with a selected one of the stops.

U.S. Pat. No. 2,147,052 which issued to Noone in 1939 uses jaws that are clamped in interlocking engagement and held in position by fasteners.

U.S. Pat. No. 4,014,406 which issued to Easton in 1977 uses a rack within the housing that is engaged by a pair of opposed inclined plane wedges forced locked in a selected position by a compound lever.

U.S. Pat. No. 4,423,797 which issued to Batten in 1984 extends locking pins through aligned apertures in the housing and telescopic member.

U.S. Pat. 4,807,720 which issued to Kim in 1989 uses a travel slot in the housing with a plurality of notches designating locking positions. A latching pin travels along the slot and is biased by a spring into engagement with a selected one of the notches.

SUMMARY OF THE INVENTION

What is required is ladder levelling device that has a mode of adjustment that is fast and easy to use.

According to the present invention there is provided a ladder levelling device which includes a housing, a telescopic member and a lever. The housing has an interior cavity, a first end, a second end, a ladder attachment side, an opposed side, an bearing edge and an opposed edge. A plurality of bearing profiles are positioned at spaced at intervals in the bearing edge. Means is provided for securing the ladder attachment side of the housing to a ladder. The telescopic member is telescopically received in the interior cavity of the housing. The telescopic member has an interior cavity, a handgrip end, a ground engaging end, a ladder facing side, an opposed side, an aperture bearing edge and an opposed edge. The telescopic member is longer than the housing. The handgrip end extends past the first end of the housing. The ground engaging end extends past the second end of the housing. An aperture is provided in the aperture bearing edge of the telescopic member at an intermediate position between the handgrip end and the ground engaging end. A lever access opening extends through the opposed side of the telescopic member at the handgrip end. The lever is positioned within the interior cavity of the telescopic member. The lever has a mounting end and a gripping end. The mounting end of the lever is pivotally mounted at the ground engaging end of the telescopic member. The gripping end of the lever is accessible through the lever access opening at the handgrip end of the telescopic member. A contact member is carried by the lever at an intermediate position between the mounting end and the gripping end. The lever is pivotable between a locking position and a release position. In the locking position the contact member carried by the lever extends through the aperture in the telescopic member and engages one of the plurality of bearing profiles in the housing. In the release position, the contact member is retracted from the bearing profiles in the housing. Means is provided for biasing the lever into the locking position.

The ladder levelling device, as described above, can be rapidly adjusted by merely pulling on the gripping end of the lever. The lever provides a mechanical advantage reducing the force required a to make the adjustment. When ladder levelling device is lifted off the ground, telescopic member falls by force of gravity when lever is in the release position.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
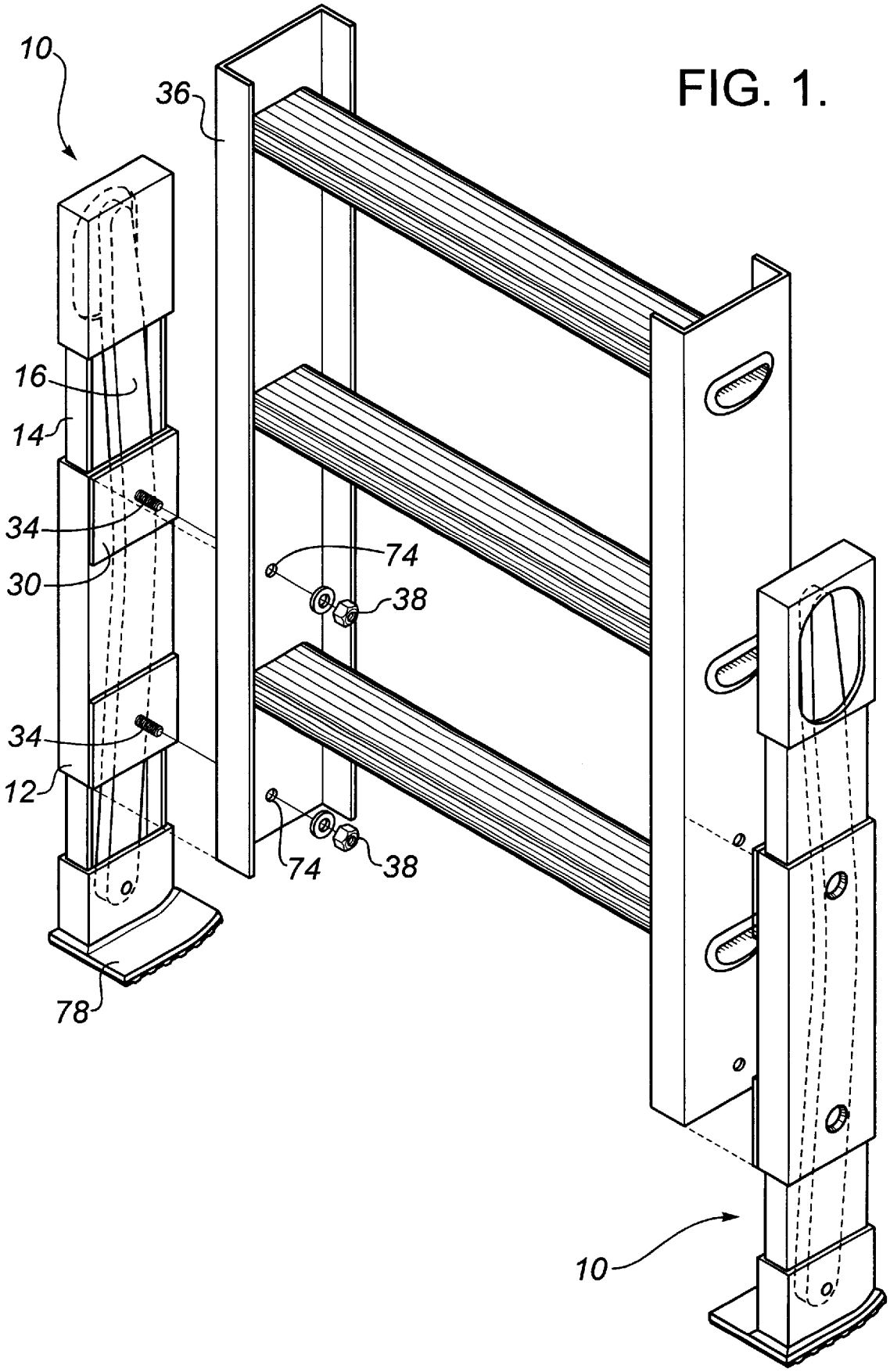
FIG. 1 is an exploded perspective view of a ladder levelling device constructed in accordance with the teachings of the present invention secured to a ladder.

The preferred embodiment, a ladder levelling device generally identified by reference numeral 10, will now be described with reference to FIGS. 1 through 6.

Figure 2:
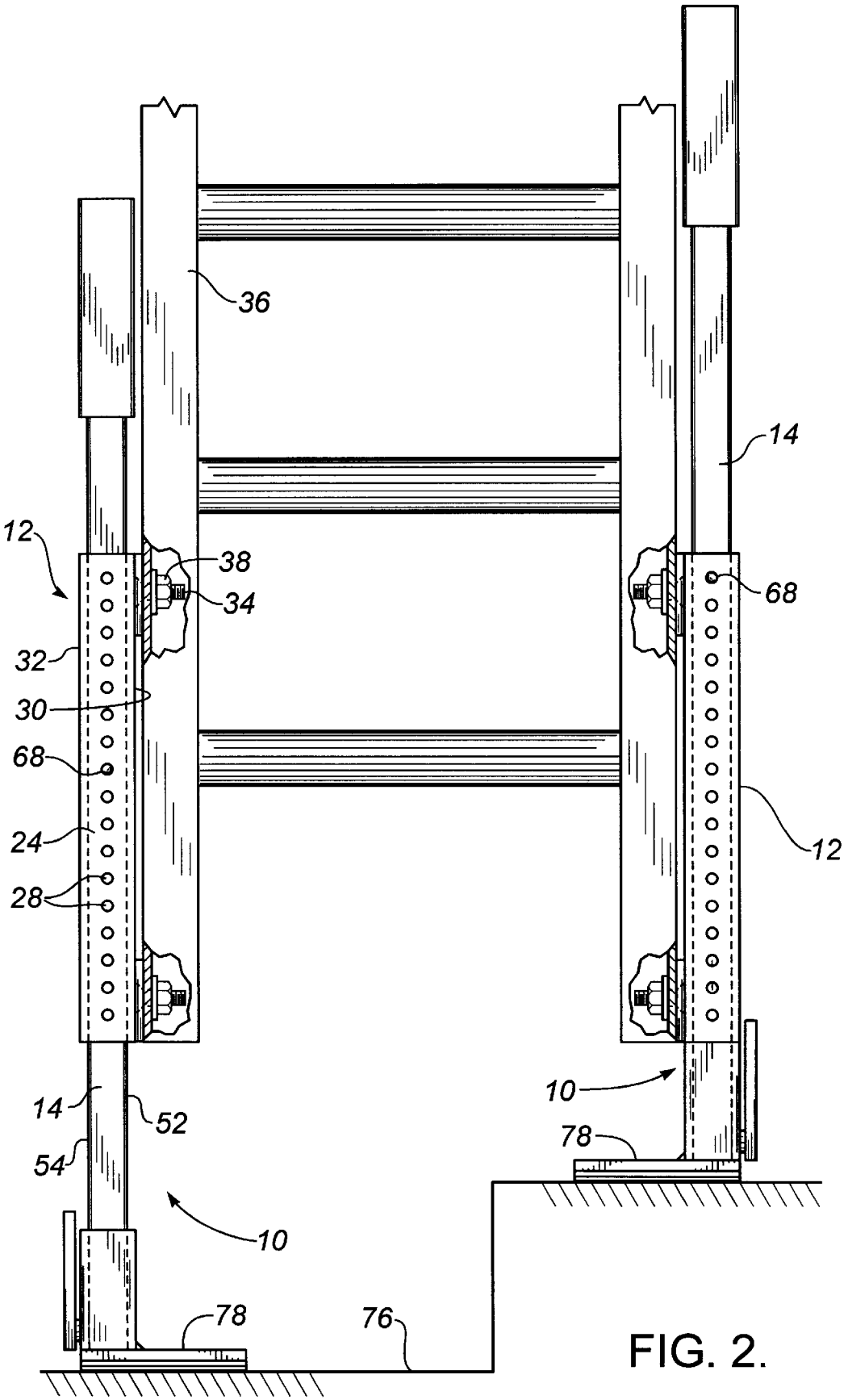
FIG. 2 is a partially cut away front elevation view of the ladder levelling device illustrated in FIG. 1.
Figure 3:
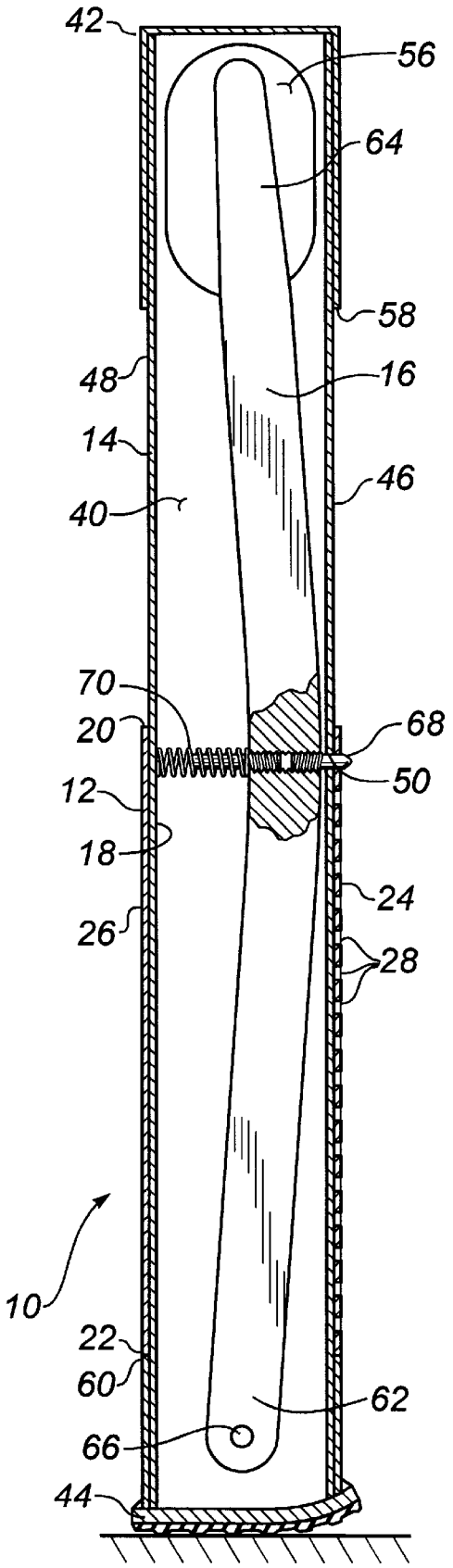
FIG. 3 is side elevation view, in section, of the ladder levelling device illustrated in FIG. 1 in a locking position.
Figure 4:
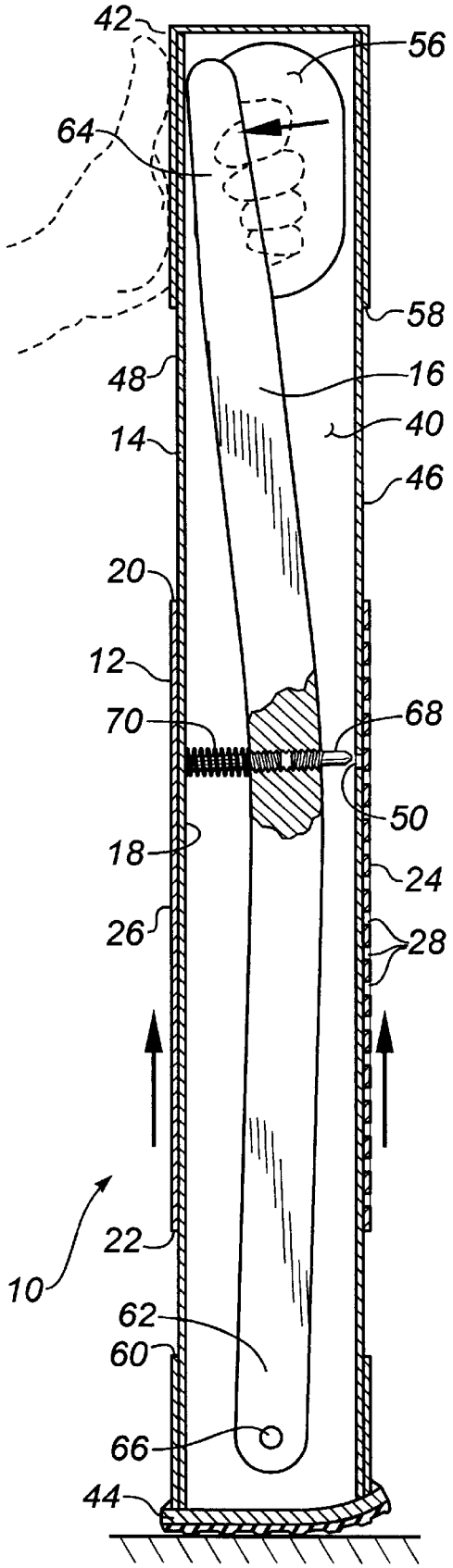
FIG. 4 is side elevation view, in section, of the ladder levelling device illustrated in FIG. 1 in a release position.
Figure 5:
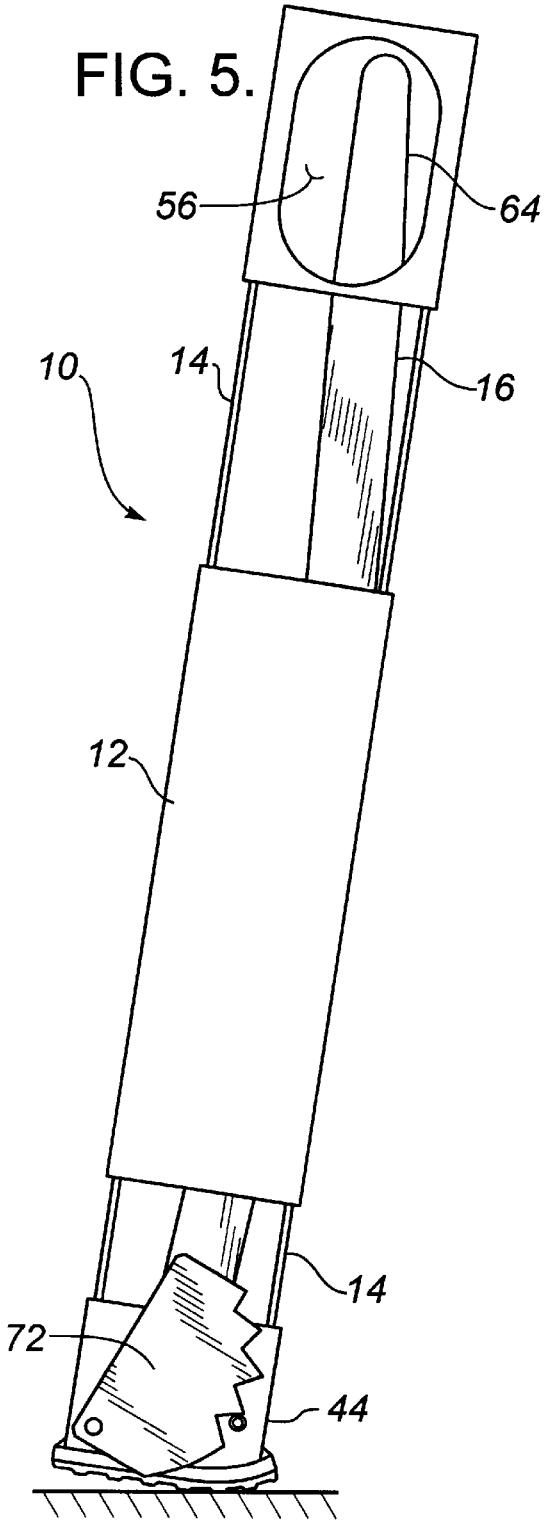
FIG. 5 is side elevation view of the ladder levelling device illustrated in FIG. 1 with an ice pick in a stored position.
Figure 6:
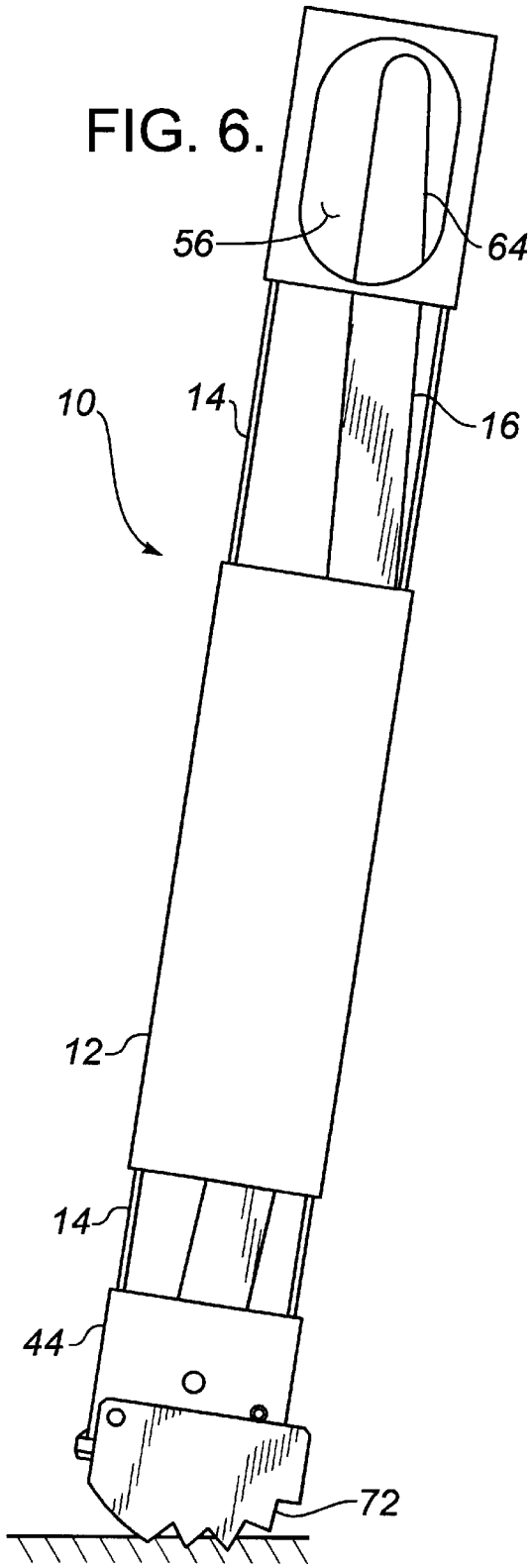
FIG. 6 is side elevation view of the ladder levelling device illustrated in FIG. 1 with the ice pick in a ground engaging position.

Referring to FIGS. 3 and 4, ladder levelling device 10 includes a housing 12, a telescopic member 14 and a lever 16. The housing 12 has an interior cavity 18, a first end 20, a second end 22, an aperture bearing edge 24 and an opposed edge 26. A plurality of apertures 28 are spaced at intervals along aperture bearing edge 24. Referring to FIG. 2, housing 12 has a ladder attachment side 30 and an opposed side 32. Bolts 34 extend from ladder attachment side 30 of housing 12 whereby housing 12 is attached to a ladder 36 and secured in position by nuts 38. Referring to FIGS. 3 and 4, the telescopic member 14 is telescopically received in interior cavity 18 of housing 12. Telescopic member 14 has an interior cavity 40, a handgrip end 42, a ground engaging end 44, an aperture bearing edge 46 and an opposed edge 48. Telescopic member 14 is longer than housing 12. Handgrip end 42 extends past first end 20 of housing 12. Ground engaging end 44 extends past second end 22 of housing 12. A single aperture 50 is positioned in aperture bearing edge 46 of telescopic member 14 at an intermediate position between handgrip end 42 and ground engaging end 44. Referring to FIG. 2, telescopic member 14 has a ladder facing side 52 and an opposed side 54. Referring to FIG. 3 and 4, a lever access opening 56 extends through opposed side 54 of telescopic member 14 at handgrip end 42. Telescopic member 14 has shoulders 58 and 60 located at handgrip end 42 and ground engaging end 44, respectively. Shoulders 58 and 60 serve as stops to limit the travel of telescopic member 14 relative to housing 12. Lever 16 has a slight dogleg bend. Lever 16 is positioned within interior cavity 40 of telescopic member 14. Lever 16 has a mounting end 62 and a gripping end 64. Mounting end 62 of lever 16 is pivotally mounted by pivot pin 66 at ground engaging end 44 of telescopic member 14. Gripping end 64 of lever 16 is accessible through lever access opening 56 at handgrip end 42 of telescopic member 14. A locking pin 68 is carried by lever 16 at an intermediate position between mounting end 62 and gripping end 64. Lever 16 is pivotable between a locking position illustrated in FIG. 3 and a release position illustrated in FIG. 4. Referring to FIG. 3, in the locking position locking pin 68 carried by lever 16 extends through single aperture 50 in telescopic member 14 and engages one of plurality of apertures 28 in housing 12. Referring to FIG. 4, in the release position locking pin 68 is retracted from apertures 28 of housing 12. A spring 70 is disposed in interior cavity 40 of telescopic member 14, biasing lever 16 into the locking position. Referring to FIGS. 5 and 6, an optional additional features is the provision of ice pick plate 72. Ice pick plate 72 is pivotally mounted to ground engaging end 44 of telescopic member 14 for movement between a ground engaging position illustrated in FIG. 6 and a stored position illustrated in FIG. 5.

The use and operation of ladder levelling device 10 will now be described with reference to FIGS. 1 through 6. Referring to FIGS. 1 and 2, ladder levelling device 10 is secured to ladder 36 by drilling holes 74 through ladder 36 and inserting bolts 34 which extend from ladder attachment side 30 of housing 12 through holes 74. Bolts 34 are then secured in position by nuts 38. Referring to FIG. 3, spring 70 biases lever 16 into the locking position. In the locking position, locking pin 68 carried by lever 16 extends through single aperture 50 in telescopic member 14 and engages one of plurality of apertures 28 in housing 12. Referring to FIG. 4, in order to move lever to the release position a person must reach through lever access opening 56, grip gripping end 64 of lever 16 and move lever 16 to overcome the biasing force of spring 70. In the release position, locking pin 68 is retracted from apertures 28 of housing 12. It should be noted the ease of adjustment with lever 16, as compared to the means of adjustment taught in the prior art. Lever 16 provides a mechanical advantage making it easier to overcome the biasing force of spring 70. This also enables a more powerful spring to be used for spring 70 without adversely effecting a persons ability to make adjustments. Referring to FIG. 2, there is illustrated an uneven surface provided by a set of stairs 76, where ladder levelling device 10 is required to stabilize ladder 36. There are two environments, in particular, where ladder levelling devices sometimes have problems. One environment is on narrow stairs. Each of ground engaging ends 44 of telescopic member 14 have inwardly extending base plates 78. Base plates 78 provide for greater stability on narrow stairs, where one of ground engaging ends 44 would otherwise be teetering on an edge of the stair. Another environment is on ice, where ground engaging ends 44 of ladder 36 are in danger of sliding. Ice pick plate 72 is pivotally mounted to ground engaging end 44 of telescopic member 14 for movement between a ground engaging position illustrated in FIG. 6 and a stored position illustrated in FIG. 5. In most situations in will remain in a stored position. When ice is encountered, ice pick plate 72 is pivoted to the ground engaging position illustrated in FIG. 6 to prevent ladder levelling device 10 from slipping on ice.

It will be apparent to one skilled in that art that other types of contact member can be substituted for locking pin 68. It will also be apparent to one skilled in the art that blind bores, slots, grooves, and other types of bearing profiles can be substituted for apertures 28 in housing 12. It will further be apparent to one skilled in that art that it may be desirable to configure lever access opening 56 along one edge so as to preclude the entry of dirt into telescopic member 14. It will finally be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A ladder levelling device, comprising:

a housing having an interior cavity, a first end, a second end, a ladder attachment side, an opposed side, a bearing edge and an opposed edge, a plurality of bearing profiles at spaced at intervals in the bearing edge;

means for securing the ladder attachment side of the housing to a ladder;

a telescopic member telescopically received in the interior cavity of the housing and having an interior cavity, a handgrip end, a ground engaging end, a ladder facing side, an opposed side, an aperture bearing edge and an opposed edge, the member being longer than the housing with the handgrip end extending past the first end of the housing and the ground engaging end extending past the second end of the housing, an aperture in the aperture bearing edge of the telescopic member at an intermediate position between the handgrip end and the ground engaging end, a lever access opening extending through the opposed side of the telescopic member at the handgrip end;

a lever positioned within the interior cavity of the telescopic member, the lever having a mounting end and a gripping end, the mounting end of the lever being pivotally mounted at the ground engaging end of the telescopic member, the gripping end of the lever being accessible through the lever access opening at the handgrip end of the telescopic member, a contact member carried by the lever at an intermediate position between the mounting end and the gripping end; the lever being pivotable between a locking position and a release position, in the locking position the contact member carried by the lever extends through the aperture in the telescopic member and engages one of the plurality of bearing profiles in the housing, in the release position the contact member is retracted from the bearing profiles in the housing; and means biasing the lever into the locking position.

2. The ladder levelling device as defined in claim 1, wherein the bearing profiles are apertures.

3. The ladder levelling device as defined in claim 1, wherein the contact member is a locking pin.

4. The ladder levelling device as defined in claim 1, wherein the lever has a slight dogleg.

5. The ladder levelling device as defined in claim 1, wherein an ice pick is pivotally mounted to the ground engaging end of the telescopic member for movement between a ground engaging position and a stored position.

6. The ladder levelling device as defined in claim 1, wherein the means for securing the means for securing the ladder attachment side of the housing to a ladder includes bolts secured to the ladder attachment side of the housing.

7. The ladder levelling device as defined in claim 1, wherein stops are mounted at both the handgrip end and the ground engaging end of the telescopic member to limit the travel of the telescopic member relative to the housing.

8. The ladder levelling device as defined in claim 7, wherein an ice pick is pivotally mounted to the ground engaging end of the telescopic member for movement between a ground engaging position and a stored position.

9. The ladder levelling device as defined in claim 1, wherein inwardly extending base extension plates are positioned on the ground engaging ends of the telescopic member.

10. A ladder levelling device, comprising:

a housing having an interior cavity, a first end, a second end, a ladder attachment side, an opposed side, an aperture bearing edge and an opposed edge, a plurality of apertures at spaced at intervals in the aperture bearing edge;

bolts extend from the ladder attachment side of the housing whereby the housing is attached to a ladder;

a telescopic member telescopically received in the interior cavity of the housing and having an interior cavity, a handgrip end, a ground engaging end, a ladder facing side, an opposed side, an aperture bearing edge and an opposed edge, the member being longer than the housing with the handgrip end extending past the first end of the housing and the ground engaging end extending past the second end of the housing, an aperture in the aperture bearing edge of the telescopic member at an intermediate position between the handgrip end and the ground engaging end, a lever access opening extending through the opposed side of the telescopic member at the handgrip end;

stops mounted at both the handgrip end and the ground engaging end of the telescopic member to limit the travel of the telescopic member relative to the housing;

a lever with a slight dogleg bend positioned within the interior cavity of the telescopic member, the lever having a mounting end and a gripping end, the mounting end of the lever being pivotally mounted at the ground engaging end of the telescopic member, the gripping end of the lever being accessible through the lever access opening at the handgrip end of the telescopic member, a locking pin being carried by the lever at an intermediate position between the mounting end and the gripping end; the lever being pivotable between a locking position and a release position, in the locking position the locking pin carried by the lever extends through the aperture in the telescopic member and engages one of the plurality of apertures in the housing, in the release position the locking pin is retracted from the apertures in the housing; and a spring disposed in the interior cavity of the telescopic member biasing the lever into the locking position.

* * * * *